US006811520B2

(12) United States Patent
Wu et al.

(10) Patent No.: US 6,811,520 B2
(45) Date of Patent: Nov. 2, 2004

(54) MAGNETIC CONTROL MULTIFUNCTIONAL EXERCISE APPARATUS WITH DOUBLE CABLE SHEAVE

(76) Inventors: Peter Wu, No.1, Lane 233, Sec.2, Charng Long Rd., Taiping (TW), 411; Leao Wang, No.1, Lane 233, Sec.2, Charng Long Rd., Taiping (TW), 411

( * ) Notice: Subject to any disclaimer, the term of this patent is extended or adjusted under 35 U.S.C. 154(b) by 342 days.

(21) Appl. No.: 10/174,832

(22) Filed: Jun. 20, 2002

(65) Prior Publication Data

US 2003/0032528 A1 Feb. 13, 2003

Related U.S. Application Data

(63) Continuation-in-part of application No. 09/928,713, filed on Aug. 13, 2001, now Pat. No. 6,599,223.

(51) Int. Cl.[7] ..... A63B 21/00

(52) U.S. Cl. ..... 482/92; 482/4; 482/138; 482/902

(58) Field of Search ..... 482/1–9, 51, 52, 482/70, 92, 98–103, 111, 133–143, 900–903

(56) References Cited

U.S. PATENT DOCUMENTS 5,569,138 A * 10/1996 Wang et al. ..... 482/130
5,711,749 A * 1/1998 Miller ..... 482/135
6,027,429 A * 2/2000 Daniels ..... 482/5

* cited by examiner

*Primary Examiner*—Glenn E. Richman
(74) *Attorney, Agent, or Firm*—Kuo-Hsiung Chiu

(57) ABSTRACT

The present invention relates to a magnetic control multifunctional exercise apparatus with double cable sheave. The exercise apparatus includes a base frame having a seat pad and an adjustable back pad. Two upright bars and one support frame are disposed at rear and front ends of the base frame. The base frame further has a magnetic control retarding mechanism provided with two cable sheaves and disposed at the bottom of the rear end of the base frame. Two pull cables are connected with two drive cables of the magnetic control retarding mechanism by means of a plurality of guide pulleys. Furthermore, a flywheel of the magnetic control retarding mechanism is coupled for unidirectional rotation, thereby reaching the expected effect of the magnetic control retarding mechanism.

2 Claims, 5 Drawing Sheets

MAGNETIC CONTROL MULTIFUNCTIONAL EXERCISE APPARATUS WITH DOUBLE CABLE SHEAVE

Continuation-in-part of U.S. patent application Ser. No. 09/928,713, filed on Aug. 13, 2001 now U.S. Pat. No. 6,599,223.

BACKGROUND OF THE INVENTION

1. Field of the Invention

The present invention relates to a magnetic control multifunctional exercise apparatus with double cable sheave, and more particularly, to a device utilizing double cable sheave to ensure a safe winding of cable and to prevent dangers caused by unbalanced application forces to both cables.

2. Description of the Prior Art

The present invention is a continuation-in-part of U.S. patent application Ser. No. 09/928,713, named as "magnetic control multifunctional exercise apparatus" by the same inventor of the present invention. It's apparent from drawings of this prior art that both ends of the pull cable 30 have different length when they are pulled with unbalanced forces. In other words, the operator has to adjust both ends of the pull cable 30 to proper position (of equal length) before taking a new exercise session. Otherwise, he feels discomfort in both hands due to unbalanced forces. Even, the effect of hardening his muscles would be affected.

Moreover, the winding process of winding wheel 23 will be affected when the external pull forces disappear and the position of both ends of the pull cable 30 much differs from each other. Therefore, the winding spring 23 inside is extremely loaded, thereby diminishing the winding force of the winding wheel 23 after use for a longer period.

SUMMARY OF THE INVENTION

It is a primary object of the present invention to remove the above-mentioned drawbacks and to provide a magnetic control multifunctional exercise apparatus with double cable sheave while the winding wheels and the drive cables are utilized. Therefore, when the drive cable at one end is pulled, the magnetic control retarding mechanism is smoothly operated as well and offers the same magnetic control retarding force preset by the operator. And the drive cable at the other end won't be influenced. When the pulling force is released, the rewinding process of the winding wheel will be automatically and exactly carried out. Thus, the present invention features much convenience and practicalness.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
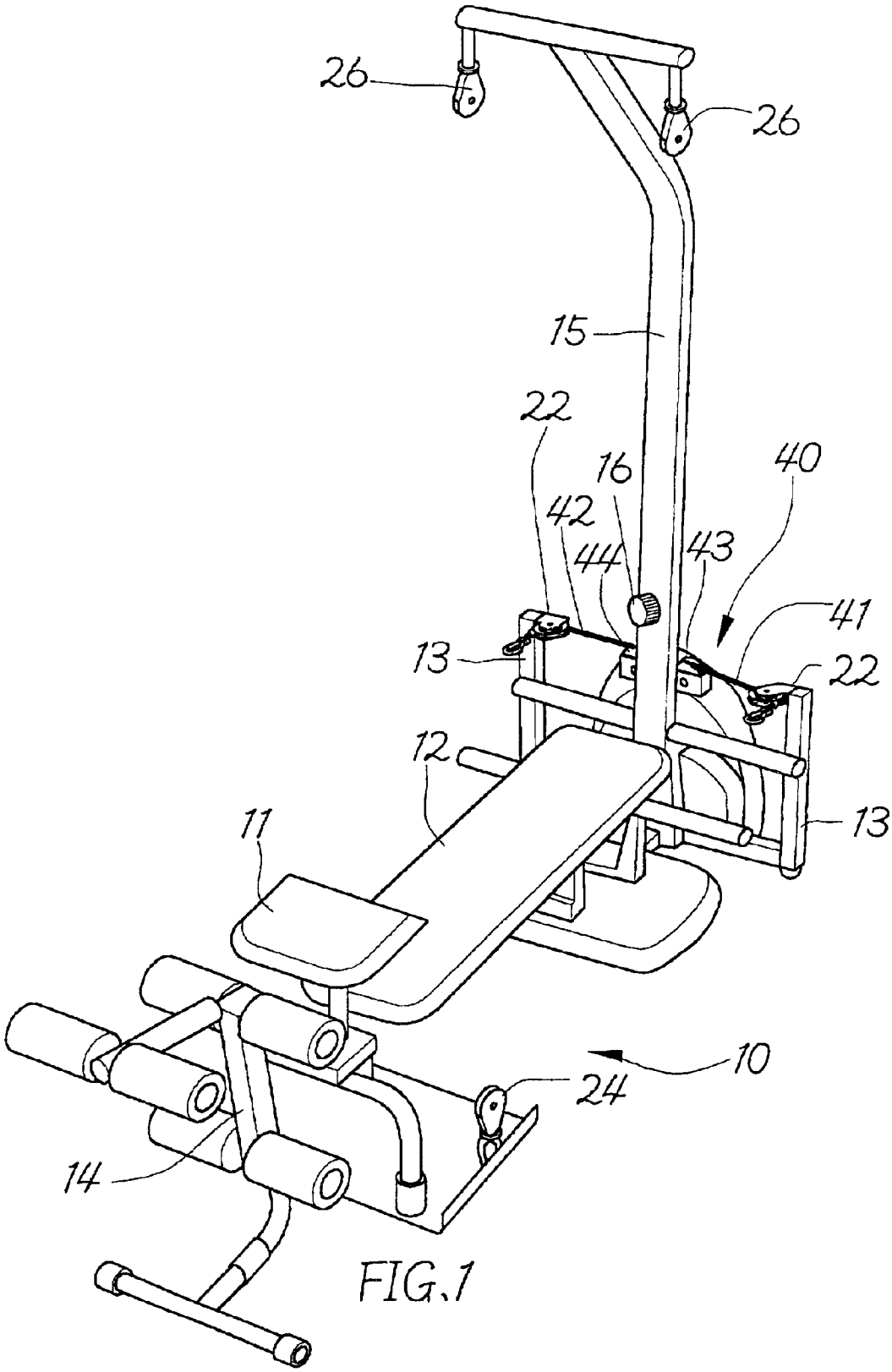
FIG. 1 is a perspective view of the present invention after assembly.
Figure 4:
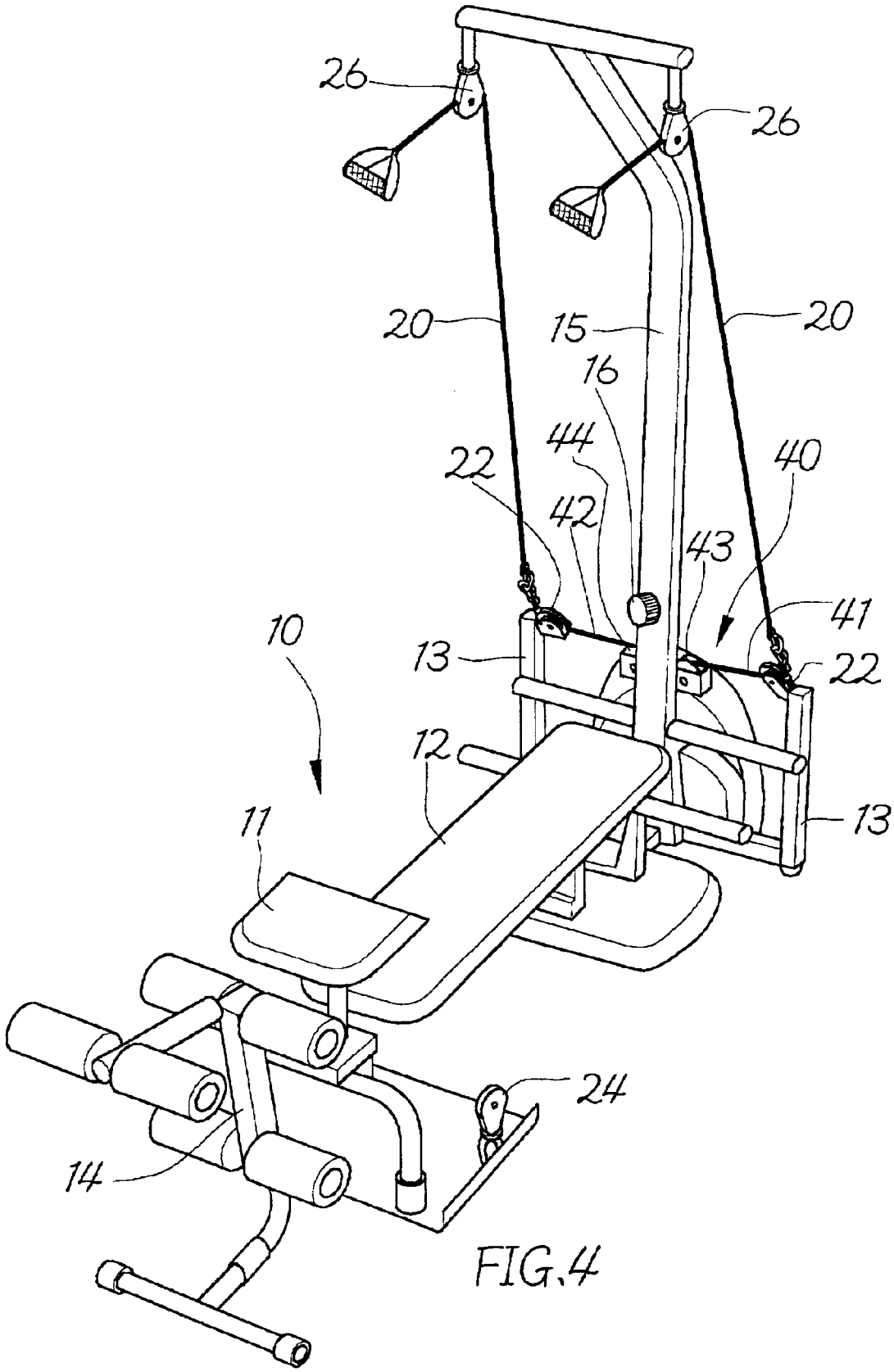
FIG. 4 is a preferred embodiment of the present invention.
Figure 5:
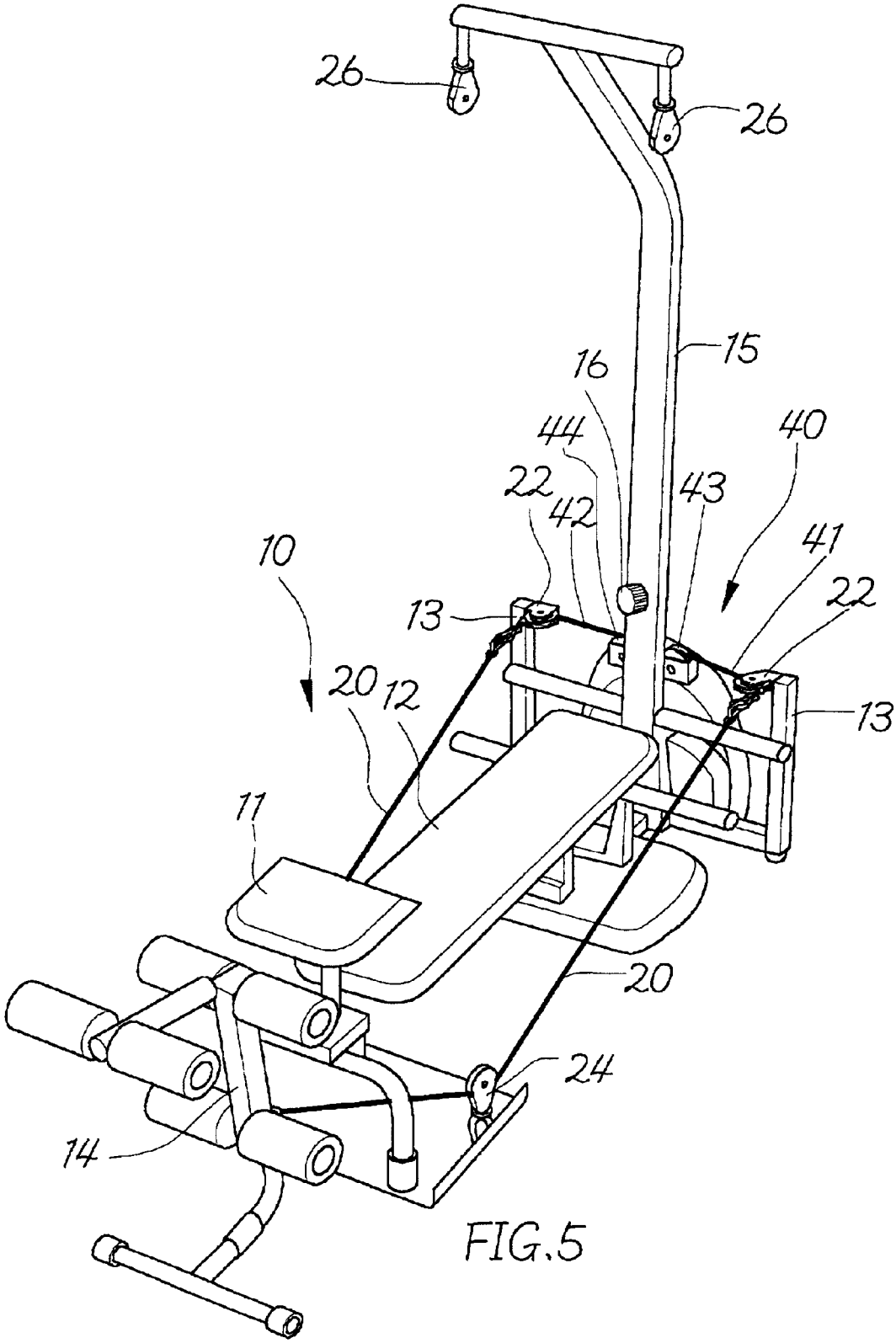
FIG. 5 is another preferred embodiment of the present invention.

First of all, referring to FIGS. 1, 4 and 5, a base frame 10 of the present invention includes a seat pad 11 and an adjustable back pad 12. Two upright bars 13 and one support frame 14 are disposed at rear and front ends of the base frame 10. The base frame 10 further has a magnetic control retarding mechanism 40 provided with two cable sheaves 46, 47 and disposed at the bottom of the rear end thereof. Two pull cables 20 are connected with two drive cables 41, 42 of the magnetic control retarding mechanism 40 by means of a plurality of guide pulleys 22, 24, 26. Furthermore, a flywheel 58 of the magnetic control retarding mechanism 40 is coupled for unidirectional rotation, thereby reaching the expected effect of the magnetic control retarding mechanism.

Again, referring to FIGS. 2 and 3, the magnetic control retarding mechanism 40 includes two drive cables 41, 42, two fixed guide pulleys 43, 44, one press pulley 45, two winding cable sheaves 46, 47, two winding wheels 48, 49, two large belt wheels 50, 51, two belts 52, 53, two small belt wheels 54, 55, two unidirectional bearings 56, 57, one flywheel 58, one flywheel's shaft 59 and a magnet set 60. The drive cables 41, 42, the fixed guide pulleys 43, 44, the winding cable sheaves 46, 47, the winding wheels 48, 49, the large belt wheels 50, 51, the belts 52, 53, the small belt wheels 54, 55 and the unidirectional bearings 56, 57 constitute two sets of power transmission system. These two are coupled with the flywheel's shaft 59 by means that the small belt wheels 54, 55 are in contact with the unidirectional bearings 56, 57. Accordingly, the flywheel 58 can be driven to rotate on the flywheel's shaft 59.

The press pulley 45 is used to guide the first drive cable 41 in the expected direction such that both winding cable sheaves 46, 47 release or rewind both drive cables 41, 42 in the same direction.

By means of the winding springs 481, the winding wheels 48, 49 drive the winding cable sheaves 46, 47 such that the drive cables 41, 42 can be reversely rewound. This feature has been disclosed in the prior art of the same inventor so that no more descriptions are given hereinafter.

The unidirectional bearings 56, 57 are combined with the small belt wheels 54, 55 in a body so as to drive the flywheel's shaft 59 in single direction. Therefore, the flywheel 58 in connection with the flywheel's shaft 59 is able to rotate in single direction.

Furthermore, the magnet set 60 is provided with a cable adjusting device 61 through which the operator is able to turn a knob 16 arranged on a vertical frame 15 of the base frame 10 to adjust the magnetic resistance. This element has been disclosed in the prior art of the same inventor of the present invention so that no further descriptions are given hereinafter.

Figure 2:
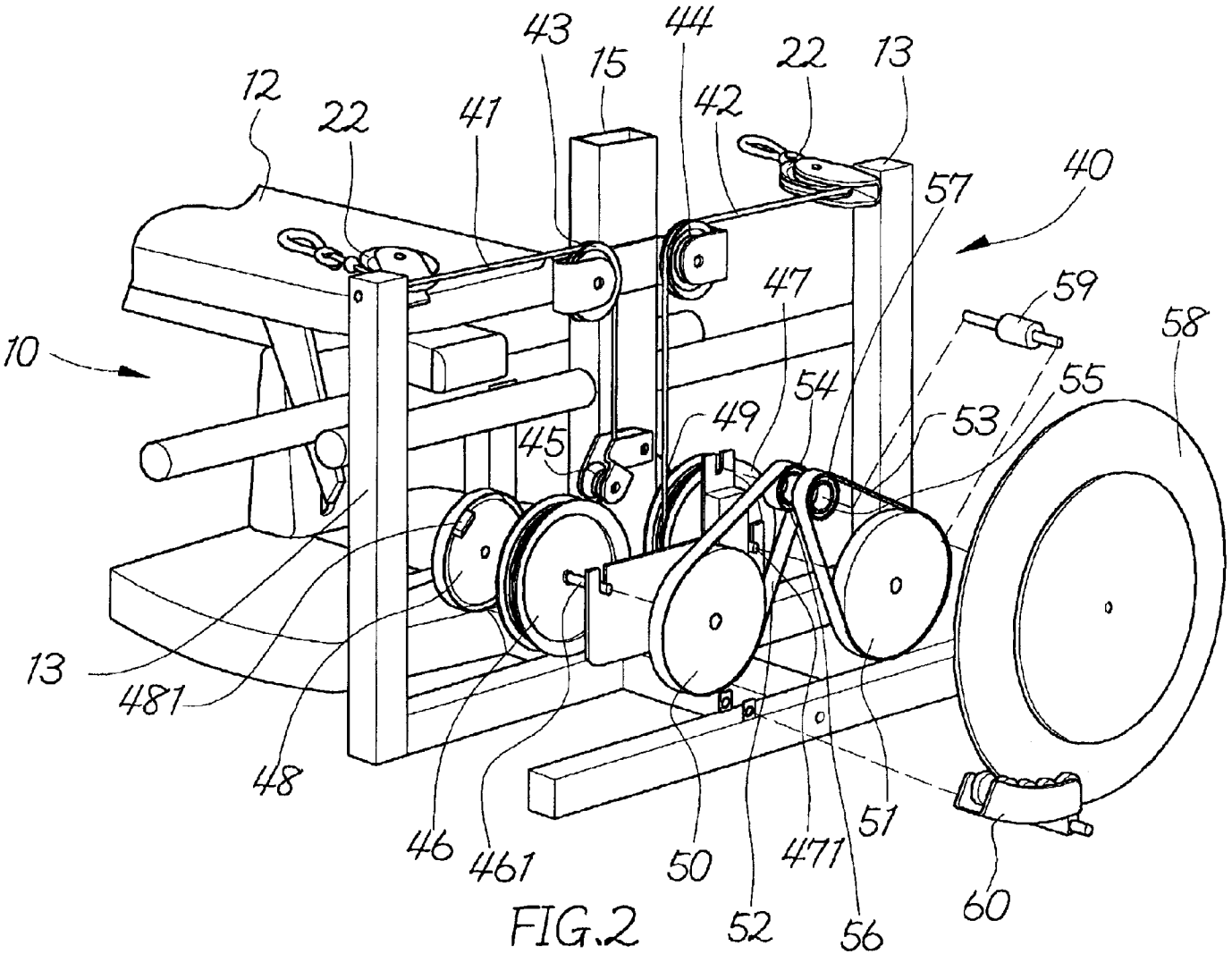
FIG. 2 is a locally exploded view of a magnetic control retarding mechanism of the present invention.
Figure 3:
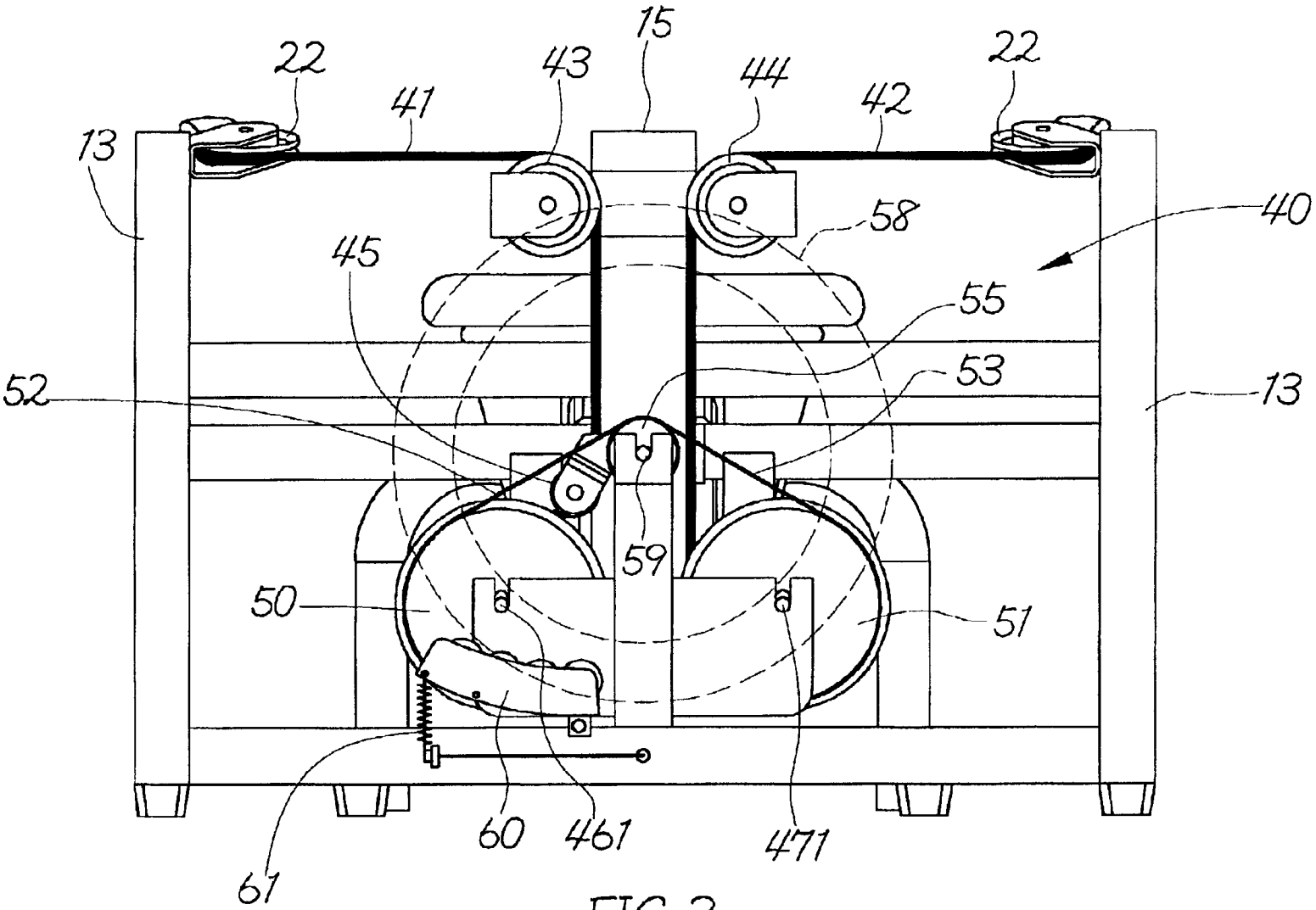
FIG. 3 is a plan view of the magnetic control retarding mechanism of the present invention.

As shown in FIGS. 2 and 3, the winding cable sheaves 46, 47 release the drive cables 41, 42 and rotate when the drive cables 41, 42 are forced. Meanwhile, the winding springs 481 within the winding wheels 48, 49 is rewound in tightened state. When the winding cable sheaves 46, 47 rotate, the large belt wheels 50, 51 are driven to rotate synchronically with cable sheave shafts 461, 471 because the winding cable sheaves 46, 47 and the large belt wheels 50, 51 are coaxially fixed. By means of the rotating transmission of the belts 52, 53 and the small belt wheels 54, 55, the flywheel 58 is rotated in single direction to produce proper magnetic resistance. To the contrary, when the external force disappears, the winding cable sheaves 46, 47 are reversely rotated by the restoring force of the winding springs 481 so as to rewind the drive cables 41, 42 in position. Meanwhile, the inertia rotation of the flywheel 58 won't be influenced.

The winding wheels 48, 49 are fixed at proper places of the base frame 10, and the winding springs 481 are also fixed at proper place of the winding cable sheaves 46, 47. Thus, only the winding springs 481 are brought into movement and the winding wheels 48, 49 are in standstill when the winding cable sheaves 46, 47 are rotated.

As shown in FIGS. 4 and 5, the operator is able to use two additional pull cables 20 to couple with the drive cables 41, 42 of the magnetic control retarding mechanism 40 by means of a plurality of guide pulleys 22, 24, 26 for taking expected exercise session.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A magnetic control multifunctional exercise apparatus with double cable sheave comprising:

a base frame;

a seat pad;

a back pad;

two upright bars disposed at both sides of the rear end of said base frame;

a support frame arranged at front end of said base frame;

a magnetic control retarding mechanism provided with two cable sheaves and disposed at the bottom of the rear end of said base frame, wherein two additional pull cables are used to couple with two drive cables of the magnetic control retarding mechanism by means of a plurality of guide pulleys such that a coupled flywheel of said magnetic control retarding mechanism is rotatable in single direction, thereby reaching the expected effect of the magnetic control retarding mechanism.

2. The magnetic control multifunctional exercise apparatus of claim 1, wherein said magnetic control retarding mechanism includes two drive cables, two fixed guide pulleys, one press pulley, two winding cable sheaves, two winding wheels, two large belt wheels, two belts, two small belt wheels, two unidirectional bearings, one flywheel, one flywheel's shaft and a magnet set, and wherein said drive cables, said fixed guide pulleys, said winding cable sheaves, said winding wheels, said large belt wheels, said belts, said small belt wheels and said unidirectional bearings constitute two sets of power transmission system which are coupled with said flywheel's shaft by means that said small belt wheels are in contact with said unidirectional bearings such that said flywheel is driven to rotate on said flywheel's shaft.

* * * * *